US009119229B2

(12) United States Patent
Herrbach et al.

(10) Patent No.: US 9,119,229 B2
(45) Date of Patent: Aug. 25, 2015

(54) ELECTRIC HEATER

(71) Applicants: Behr France Rouffach SAS, Rouffach (FR); Nagares S.A., Cuenca (ES)

(72) Inventors: Stephane Herrbach, Triembach au-Val (FR); Michel Brun, Rustenhart (FR); Marc Bauer, Habsheim (FR); Luis Felipe Rodriguez, Valencia (ES); Christoph Schmidt, Valencia (ES); Jesus Calvo, Valencia (ES); Herminio Navalo Carretero, Motilla Palancar (ES)

(73) Assignee: MAHLE Behr France Rouffach SAS, Rouffach (FR)

( * ) Notice: Subject to any disclaimer, the term of this patent is extended or adjusted under 35 U.S.C. 154(b) by 120 days.

(21) Appl. No.: 13/768,347

(22) Filed: Feb. 15, 2013

(65) Prior Publication Data

US 2013/0240503 A1 Sep. 19, 2013

(30) Foreign Application Priority Data

Feb. 16, 2012 (EP) ..... 12290056

(51) Int. Cl.
*H05B 3/02* (2006.01)
*H05B 1/02* (2006.01)

(52) U.S. Cl.
CPC ..... *H05B 1/0236* (2013.01)

(58) Field of Classification Search
None
See application file for complete search history.

(56) References Cited

U.S. PATENT DOCUMENTS

| | | | | |
|---|---|---|---|---|
| 7,064,292 | B1 | 6/2006 | Oishi et al. | |
| 2007/0095815 | A1 * | 5/2007 | Brun et al. | 219/481 |
| 2007/0287201 | A1 | 12/2007 | Ishizu et al. | |

FOREIGN PATENT DOCUMENTS

| | | | |
|---|---|---|---|
| DE | 10 2008 056 757 | A1 | 6/2009 |
| EP | 1 542 504 | A1 | 6/2005 |

* cited by examiner

*Primary Examiner* — Shawntina Fuqua
(74) *Attorney, Agent, or Firm* — Muncy, Geissler, Olds & Lowe, P.C.

(57) ABSTRACT

An electric heater is provided that includes at least two groups of heating elements which change their temperature by electrical power consumption, comprising a control unit with two switch arrangements such that the first switch arrangement includes at least two power switches for switching the at least two groups of heating elements in a High-side connection and such that the second power switch arrangement includes at least two switches for switching the at least two groups of heating elements in a Low-side connection.

9 Claims, 2 Drawing Sheets

ELECTRIC HEATER

This nonprovisional application claims priority under 35 U.S.C. §119(a) to European Patent Application No. 12290056.6-2214, which was filed on Feb. 16, 2012, and which is herein incorporated by reference.

BACKGROUND OF THE INVENTION

1. Field of the Invention

The present invention relates an electric heater comprising N groups of heating elements which change their temperature due to electrical power consumption.

2. Description of the Background Art

Electrical heaters are known for automotive applications. Within air-conditioning systems electrical heaters are widely used to heat up the air before entering the passenger compartment especially at cold-start conditions and in case the cooling liquid of the cooling liquid circuit of the combustion engine is not sufficiently heated by the combustion engine. Usually after the cooling liquid has almost reached the steady state temperature the electrical heater will be switched off by a control unit. Therefore the electrical heater is regarded as auxiliary heater in addition to a heater core supplied by a cooling liquid of the cooling circuit of the combustion engine. For electrically driven vehicles the mentioned heater is the main heater of the vehicle.

In automotive vehicles using combustion engines as main drive unit the electric power circuit typically uses a low-voltage configuration. Applications for pure electrical vehicles or hybrid-drive vehicles comprising an electric drive unit and a combustion engine are using high-voltage circuits in order to provide the necessary electrical power to the electric drive unit. Low-voltage means for sake of clarity a voltage below 50 V, high-voltage means a voltage of about 50 V or more, especially above 100 V up to 300 V or 500 V.

With regard to high-voltage applications safety is a very important issue within automotive applications. For the use of high-voltage systems in automotive applications the system has to be designed in such a way that nobody may be injured even in case of a failure of the system.

SUMMARY OF THE INVENTION

It is therefore an object of the invention to provide an electric heater which is useful for high-voltage applications and can be manufactured easily at a low cost basis.

The present invention in a first aspect provides an electric heater comprising at least N groups of heating elements which change their temperature by electrical power consumption, comprising a control unit with two switch arrangements such that the first switch arrangement includes at least N power switches for switching the at least N groups of heating elements in a high voltage side connection and such that the second power switch arrangement includes at least N switches for switching the at least N groups of heating elements in a low voltage side connection, wherein N is one, two or more. According to a preferred embodiment N is two or more.

According to an embodiment of the invention it is of advantage that the heater further includes a first sensor arrangement for measuring the electric voltage and includes a second sensor arrangement for measuring the electric current. Therefore it is possible to allow temperature control and regulation by way of computing the actual temperature of the heater or of the heating elements and to control the electrical power supplied to the heating elements.

Furthermore, the first sensor can be arranged to measure the voltage at the High-side power switch. In a further embodiment it is possible that the first sensor is arranged to measure the voltage at the Low-side power switch.

Furthermore, the second sensor can be arranged to measure the current at the Low-side power switch. In a further embodiment it is possible that the second sensor is arranged to measure the current at the High-side power switch.

Additionally, it is of advantage that the control unit comprises a micro controller including a voltage and/or a transceiver, eg. a network or BUS transceiver.

Furthermore, the heating element can be a positive temperature coefficient type.

Of advantage is furthermore that the first power switch or the second power switch can be a continuously regulating switch, which may regulate the current or voltage of the heating elements.

Additionally, it is of advantage that the second power switch or the first power switch can be a digital or analog on-off switching switch, which may switch on or off the current or voltage of the heating elements.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention. The drawings show.

DETAILED DESCRIPTION

Figure 1:
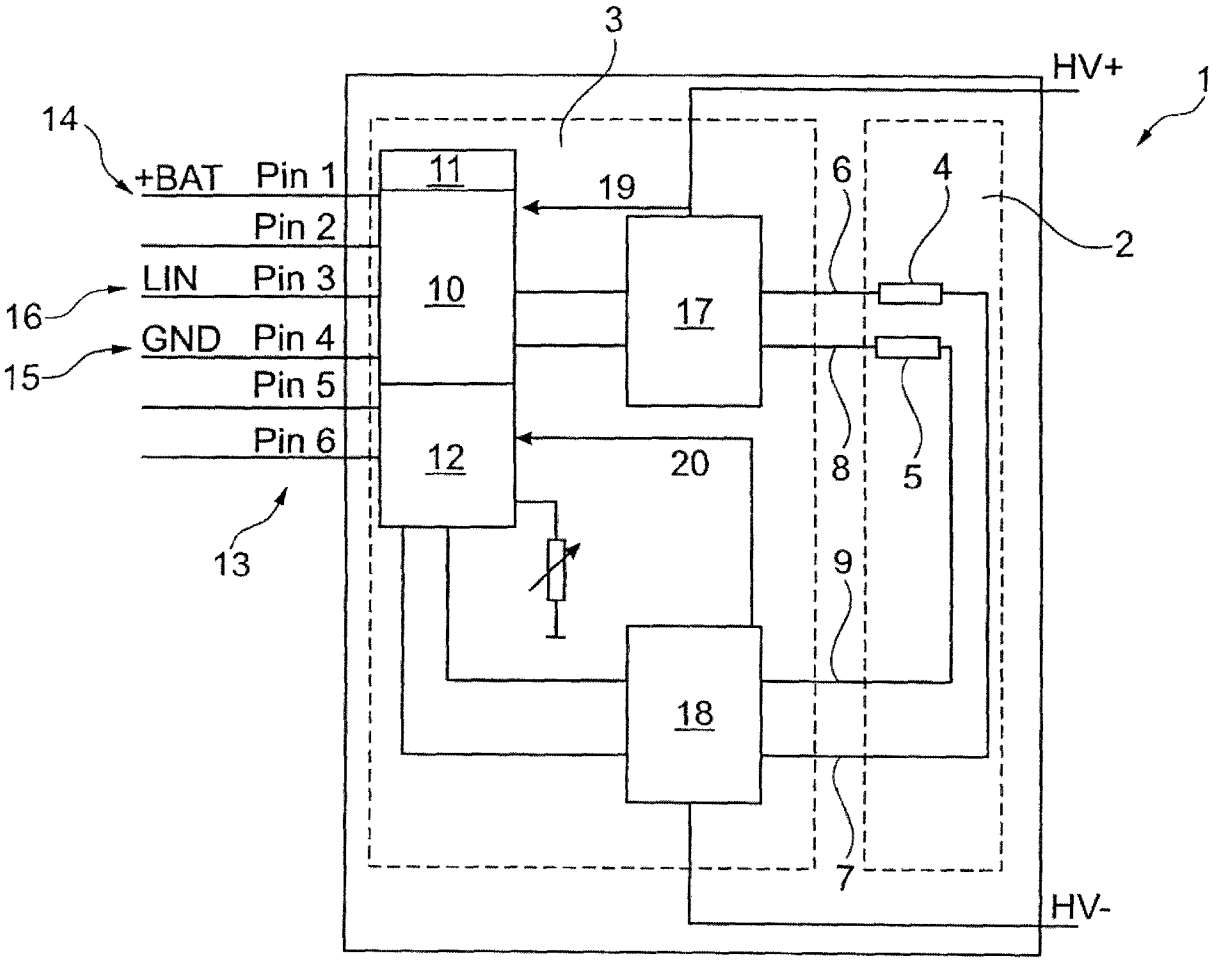
FIG. 1 is a schematic view of a circuit of an inventive embodiment.

FIG. 1 shows a schematic view of a circuit to explain the embodiment of the inventive concept. The electric heater 1 comprises a heating unit 2 and a control unit 3. The heating unit comprises at least N groups of heating elements 4, 5. In the embodiment of FIG. 1 two heating elements 4, 5 are shown. In other embodiments of the invention the number N of the heating elements may be one, two or more.

The heating elements 4, 5 may be from the positive temperature coefficient (PTC) type, such that the electric resistance increases by increasing temperature.

Each of the heating elements 4, 5 are connected to the control unit 3 by way of two electric connections 6, 7 and 8, 9. The electric connections 6, 7 and 8, 9 are preferably realized as cable or rigid metallic element or using male and female plug connectors.

The control unit 3 contains the micro controller 10 comprising a voltage supply 11 and transceiver 12, such as a LIN-bus transceiver. The micro controller includes a regular 5V supply and a watch dog controller. For external connections the controller 10 comprises a plug connector 13, which allows to connect the micro controller 10 with the battery (+BAT) 14 and with ground potential (GND) 15 and with a LIN-bus signal line (LIN) 16. The connection with battery (+BAT) 14 and with ground realizes the power supply of the controller 10 while the LIN-connection 16 allows and realizes the communication of the electric heater 1 with other electronic units of a network or Bus, like a LIN-Bus e.g. that of a motor vehicle.

The control unit 3 further comprises two switch arrangements 17, 18. The switch arrangements 17, 18 itself comprises a number N of switches. According to the embodiment of FIG. 1 the switch arrangements 17, 18 each comprise two switches. The switch arrangement 17 and the respective switches are connected to a high-voltage connection (HV+) on the high side level, while the switch arrangement 18 and the respective switches are connected to a high-voltage connection (HV−) on the low-side level. Therefore the first power switch arrangement 17 includes at least N power switches for switching the at least N groups of heating elements 4, 5 to a high-voltage high side level and such that the second power switch arrangement 18 includes at least N switches for switching the at least N groups of heating elements 4, 5 in a high-voltage low side level.

The power switch arrangements 17 and 18 and the respective switches are controlled by the micro controller 10. According to the first embodiment of the invention, the first switches of the first switch arrangement 17 are continuously switchable such that the current and/or the voltage is/are continuously adjustable. This continuous adjustment is e.g. realized as pulse width modulation (PWM) of the respective signal. According to the first embodiment of the invention, the second switches of the second switch arrangement 18 are digital or analog on-off switches such that the current and/or the voltage is either switched on or switched off. According to another embodiment of the invention, the first switch arrangement may include the on-off switches while the second switch arrangement includes the continuously switchable switches.

Therefore the inventive embodiment switches both the high-voltage high side connection and the high-voltage low side connection, while one of the two switches is continuously switchable and the other is only on-off switchable.

Furthermore the control unit 10 comprises sensor arrangements 19, 20 to measure the voltage across the heating elements and the current through the heating elements. In the embodiment of FIG. 1 the sensor arrangement 19 for measuring voltage is dedicated to the first switch arrangement 17 and the sensor arrangement 20 for measuring the current is dedicated to the second switch arrangement 18.

Furthermore the control unit 3 comprises an over temperature sensor, which switches the control unit off in case of excessive heating of the control unit.

Figure 2:
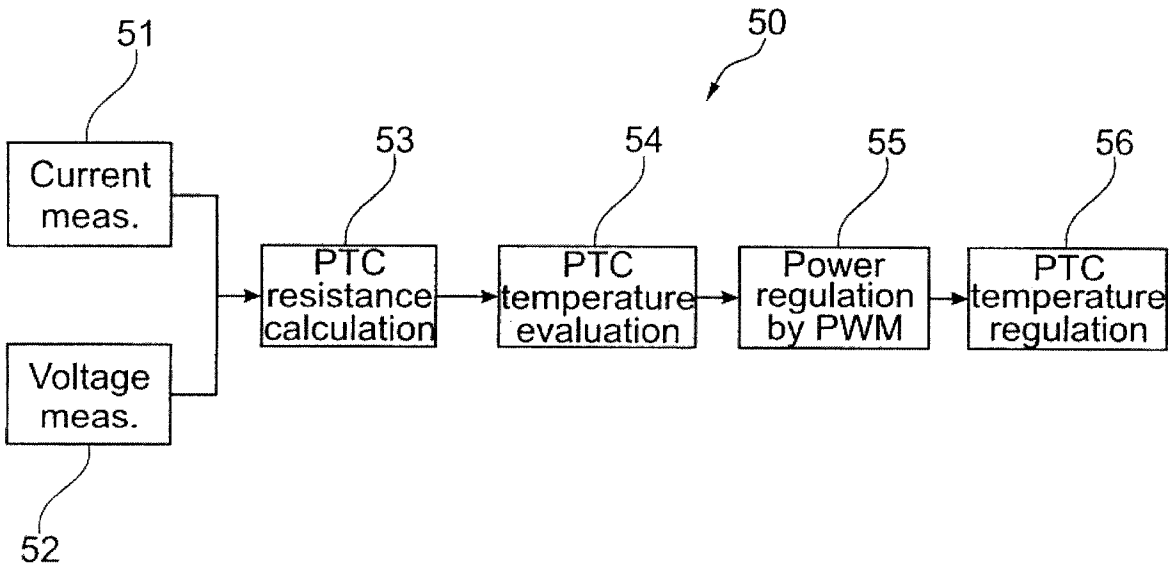
FIG. 2 is a schematic diagram to explain the method of regulating the temperature of the electric heater.

FIG. 2 shows a diagram 50 explaining the inventive method of calculating the temperature of the heating elements of the electric heater.

In block 51 the electric current flowing through the heating elements is measured. In block 52 the electric voltage across the heating elements is measured. In block 53 the electric resistance of the heating elements is calculated by the micro controller. In block 54 the temperature of the heating elements is evaluated based on the resistance data derived from the micro controller. Since the resistance of the heating elements is changing with the temperature, it is derivable from the resistance data. In block 55 the power regulation will be carried out to achieve a desired temperature of the heating elements. In Block 56 the temperature of the heating elements will be regulated by means of changing the power supplied to the heating elements e.g. via pulse width modulation.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electric heater comprising:

at least N groups of heating elements that change their temperature by electrical power consumption; and a control unit with two switch arrangements such that the first switch arrangement includes at least N power switches for switching the at least N groups of heating elements to a high-voltage high side level and such that the second switch arrangement includes at least N power switches for switching the at least N groups of heating elements in a high-voltage low side level, wherein N is one, two or more.

2. The electric heater according to claim 1, wherein the heater further comprises:

a first sensor arrangement configured to measure the electric voltage; and a second sensor arrangement configured to measure the electric current.

3. The electric heater according to claim 2, wherein the first sensor is arranged to measure the voltage at a High-side power switch.

4. The electric heater according to claim 2, wherein the second sensor is arranged to measure the current at a Low-side power switch.

5. The electric heater according to claim 1, wherein the control unit comprises a micro controller including a voltage and/or a network or Bus transceiver.

6. The electric heater according to claim 1, wherein the heating element is a positive temperature coefficient heating element.

7. The electric heater according to claim 1, wherein the at least N power switches of the first switch arrangement or the at least N power switches of the second switch arrangement are continuously regulating switches, which are configured to regulate the current or voltage of the heating elements.

8. The electric heater according to claim 1, wherein the at least N power switches of the second switch arrangement or the at least N power switches of the first switch arrangement are digital or analog on-off switching switches, which are configured to switch on or off the current or voltage of the heating elements.

9. An electric heater comprising:

at least N groups of heating elements that change their temperature by electrical power consumption; and a control unit having a first switch arrangement that includes at least N power switches for switching the at least N groups of heating elements to a high-voltage high side level and a second switch arrangement that includes at least N power switches for switching the at least N groups of heating elements in a high-voltage low side level, wherein N is one, two or more, wherein the at least N power switches of the first switch arrangement are continuously regulating switches, which are configured to regulate the current or voltage of the heating elements, and wherein the at least N power switches of the second switch arrangement are digital or analog on-off switching switches, which are configured to switch on or off the current or voltage of the heating elements.

* * * * *

UNITED STATES PATENT AND TRADEMARK OFFICE

CERTIFICATE OF CORRECTION

PATENT NO. : 9,119,229 B2
APPLICATION NO. : 13/768347
DATED : August 25, 2015
INVENTOR(S) : Herrbach et al.

It is certified that error appears in the above-identified patent and that said Letters Patent is hereby corrected as shown below:

On the title page

Item (73) Assignee: MAHLE Behr France Rouffach S.A.S., Rouffach (FR)

should read:

(73) Assignee: MAHLE Behr France Rouffach S.A.S., Rouffach (FR)
Nagares S.A., Cuence (ES)

Signed and Sealed this
Twenty-sixth Day of July, 2016

Michelle K. Lee

Michelle K. Lee
*Director of the United States Patent and Trademark Office*